US009144314B2

(12) United States Patent
Li

(10) Patent No.: US 9,144,314 B2
(45) Date of Patent: Sep. 29, 2015

(54) MULTIFUNCTIONAL POSTURE SEAT

(71) Applicant: Conghua Li, Markham (CA)

(72) Inventor: Conghua Li, Markham (CA)

( * ) Notice: Subject to any disclaimer, the term of this patent is extended or adjusted under 35 U.S.C. 154(b) by 50 days.

(21) Appl. No.: 13/902,944

(22) Filed: May 27, 2013

(65) Prior Publication Data

US 2013/0318723 A1 Dec. 5, 2013

Related U.S. Application Data

(60) Provisional application No. 61/652,787, filed on May 29, 2012.

(51) Int. Cl.

| | |
|---|---|
| ***A47C 16/00*** | (2006.01) |
| ***A47C 7/02*** | (2006.01) |
| ***A47C 27/08*** | (2006.01) |
| ***A47C 7/14*** | (2006.01) |

(52) U.S. Cl.

CPC ..... *A47C 7/021* (2013.01); *A47C 7/022* (2013.01); *A47C 7/14* (2013.01); *A47C 27/081* (2013.01); *A47C 27/086* (2013.01)

(58) Field of Classification Search

CPC . A47C 7/021; A47C 7/022; A61G 2005/1045
USPC ..... 5/654, 652, 653, 655.3, 655.9; D6/716.1, 601, 604
See application file for complete search history.

(56) References Cited

U.S. PATENT DOCUMENTS

| | | | | | |
|---|---|---|---|---|---|
| 674,451 | A | * | 5/1901 | Bunker | 297/200 |
| 1,726,939 | A | * | 9/1929 | Anderson | 267/117 |
| 1,830,570 | A | * | 11/1931 | Smith et al. | 267/117 |
| 2,343,996 | A | * | 3/1944 | Perry | 267/117 |
| 2,728,926 | A | * | 1/1956 | Emery | 5/644 |
| 3,503,084 | A | * | 3/1970 | Meinwieser | 5/630 |
| 3,503,649 | A | * | 3/1970 | Johnson | 297/452.26 |
| 5,369,829 | A | * | 12/1994 | Jay | 5/654 |
| 5,395,162 | A | * | 3/1995 | Jay et al. | 297/452.25 |
| 5,406,661 | A | * | 4/1995 | Pekar | 5/655.3 |
| 5,444,881 | A | * | 8/1995 | Landi et al. | 5/708 |
| 5,513,899 | A | * | 5/1996 | Michaels et al. | 297/452.41 |
| 5,558,395 | A | * | 9/1996 | Huang | 297/199 |
| 5,681,092 | A | * | 10/1997 | Hanson et al. | 297/452.41 |
| 5,713,631 | A | * | 2/1998 | O'Neill et al. | 297/284.6 |
| 6,003,177 | A | * | 12/1999 | Ferris | 5/636 |
| 7,497,513 | B2 | * | 3/2009 | Kim | 297/180.11 |
| 7,810,193 | B1 | * | 10/2010 | Ennis et al. | 5/655.3 |
| 8,011,045 | B2 | * | 9/2011 | Skripps | 5/655.5 |
| D647,349 | S | * | 10/2011 | Klotz | D6/601 |
| 2002/0108179 | A1 | * | 8/2002 | Kiser | 5/654 |
| 2005/0151410 | A1 | * | 7/2005 | Sprouse, II | 297/452.41 |
| 2006/0152047 | A1 | * | 7/2006 | Riondato | 297/214 |
| 2009/0295203 | A1 | * | 12/2009 | Lewis et al. | 297/219.1 |
| 2012/0292958 | A1 | * | 11/2012 | Sprouse, II | 297/200 |

* cited by examiner

*Primary Examiner* — Timothy D Collins
*Assistant Examiner* — Richard G Davis

(57) ABSTRACT

The present invention generally relates to a seat cushion comprising an air chamber with the shape and size corresponding to those of the buttock print of a user. Specifically, embodiments of the present invention are directed to a seat cushion comprising an air chamber and with an areas corresponding the coccyx, perineum area, left and right thighs of a user when the user is in a standard sitting position. In preferred embodiments of the present invention, no part of the air chamber is excluded from a single air dissipation and flow. Preferred embodiments of the present invention are further configured with one or more air valves allowing for adjustment of inflation of said air chamber.

19 Claims, 11 Drawing Sheets

D - D

F - F

MULTIFUNCTIONAL POSTURE SEAT

CROSS-REFERENCE TO RELATED APPLICATIONS

This application claims the benefit of the following provisional application, each of which is hereby incorporated by reference in its entirety: U.S. Pat. App. No. 61/652,787 filed on May 29, 2012 and entitled "MULTIFUNCTIONAL POSTURE SEAT".

FIELD OF THE INVENTION

The present invention relates to a seat cushion helping users improve pressure distribution underneath buttocks and thighs, reduce pressure on perineum area and prevent compression on coccyx while sitting, and helps reduce, relieve or prevent many health issues related to prolonged sitting.

BACKGROUND OF THE INVENTION

Prolonged sitting has brought significant health issues and discomforts to sedentary population. It is important to help sedentary people improve pressure distribution underneath the buttocks, help people with damaged or sensitive coccyx prevent compression on the coccyx, and help people with enlarged or sensitive prostates, or with hemorrhoids or mothers who recently gave birth in order to reduce pressure in the perineum area. It is of special importance to help sedentary people to reduce physical inactivity without overtly intruding their concentration on their tasks on hand, while sitting. American Institute for cancer research has linked numerous common cancers to physical inactivity of sitting.

There are various products tackling one or more of the above mentioned issues. However there is no solution that is capable of addressing all above issues. Furthermore, current devices tend to be less user friendly and less comfortable to use. And, none has succeeded to reduce physical inactivity without being risky, uncomfortable or overtly distractive to use.

Further, while there are certain support cushions and seats that provide support for one or more areas of a user's legs or other body portions, none of these support cushions provide a single air bladder capable of providing support for all of the regions identified above, such as the buttocks, thighs and coccyx.

Finally, none of the support cushions in the prior art provide a seating platform that (i) prevents the backward rolling tendency of a user's pelvis; (ii) works to prevent slouching; and (iii) provides stability stimulation for a user's upper body.

Therefore, there is a need in the art for a seat cushion helping users improve pressure distribution underneath buttocks and thighs, reduce pressure on perineum area and prevent compression on coccyx while sitting, and helps reduce, relieve or prevent many health issues related to prolonged sitting. It is important to offer sufficient proprioceptive stimulation and support to users without being risky, uncomfortable or overtly distractive to users. These and other features and advantages of the present invention will be explained and will become obvious to one skilled in the art through the summary of the invention that follows.

SUMMARY OF THE INVENTION

Accordingly, the present invention provides a seat cushion helping users improve pressure distribution underneath buttocks and thighs, reduce pressure on perineum area and prevent compression on coccyx while sitting, and offer effective proprioceptive stimulation and support in a non-risky, comfortable and non-distractive manner to help reduce or prevent many health issues related to prolonged sitting.

According to an embodiment of the present invention, a multifunctional posture seat includes: an air chamber; a first area formed in the air chamber that concaves inward from a rear edge of the multifunctional posture seat and along a front-to-back middle axle of the multifunctional posture seat, the first area configured to support a coccyx of a user; a second area formed in the air chamber running along the front-to-back middle axle of the multifunctional posture seat without touching a tip of the first area and a front edge of the seat cushion, the second area configured to support a perineum area of the user; and a plurality of areas formed in the air chamber air chamber that run inwards from the front edge along two symmetrical lines without touching the rear edge of the multifunctional posture seat, the plurality of areas configured to support, a lower left thigh area and a lower right thigh area of the user, wherein no part of the air chamber is excluded from a single air dissipation and flow channel allowing air to flow freely between the first area, the second area and the plurality of areas formed in the air chamber.

According to an embodiment of the present invention, the multifunctional posture seat further includes one or more valves integrally formed upon the air chamber.

According to an embodiment of the present invention, at least one of the valves allows for the inflation of the air chamber.

According to an embodiment of the present invention, at least one of the valves allows for the deflation of the air chamber.

According to an embodiment of the present invention, the one or more valves are configured to allow for the manual inflation of the air chamber.

According to an embodiment of the present invention, the multifunctional posture seat further includes an automated air pump means configured to provide automatic inflation and deflation of the air chamber via the one or more valves.

According to an embodiment of the present invention, the automated air pump is integrally formed in the multifunctional posture seat.

According to an embodiment of the present invention, the air chamber is prefilled with air.

According to an embodiment of the present invention, a multifunctional posture seat, includes: an air bladder bounded on an outside border formed by welding an upper side of the multifunctional posture seat to a lower side of the multifunctional posture seat; a first weld area being formed between am upper side and a lower side of the air bladder, wherein the first weld area is configured to create a first void area, the first void area creating a void of air inflation in a middle portion of the air bladder, wherein the first void area is configured to relieve pressure in a perineum region of a user.

According to an embodiment of the present invention, the multifunctional posture seat further includes: a second weld area being formed between am upper side and a lower side of the air bladder, wherein the second weld area is configured to create a second void area, the second void area creating a void of air inflation in a rear portion of the air bladder, wherein the second void area is configured to relieve pressure in the user's coccyx.

According to an embodiment of the present invention, the multifunctional posture seat further includes: a pair of third weld areas being formed between am upper side and a lower side of the air bladder, wherein the pair of third weld areas is configured to create a third void area, the third void area creating a void of air inflation in a front portion of the air bladder, wherein the third void area is configured to improve pressure distribution underneath the user's thighs.

According to an embodiment of the present invention, the multifunctional posture seat further includes one or more valves integrally formed upon the air chamber.

According to an embodiment of the present invention, the at least one of the valves allows for the inflation of the air chamber.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

BRIEF DESCRIPTION OF THE DRAWINGS

Embodiments of the invention will be described by way of example and with reference to the drawings in which.

DETAILED DESCRIPTION OF THE INVENTION

The present invention generally relates to a seat cushion comprising an air chamber with the shape and size corresponding to those of the buttock print of a user. Specifically, embodiments of the present invention are directed to a seat cushion comprising an air chamber and with areas corresponding the coccyx, perineum, ischial tuberosity or weight bearing areas, left and right thighs of a user when the user is in a standard sitting position. In preferred embodiments of the present invention, no part of the air chamber is excluded from a single air dissipation and flow. Preferred embodiments of the present invention are further configured with one or more air valves allowing for adjustment of inflation of the air chamber.

Figure 1:
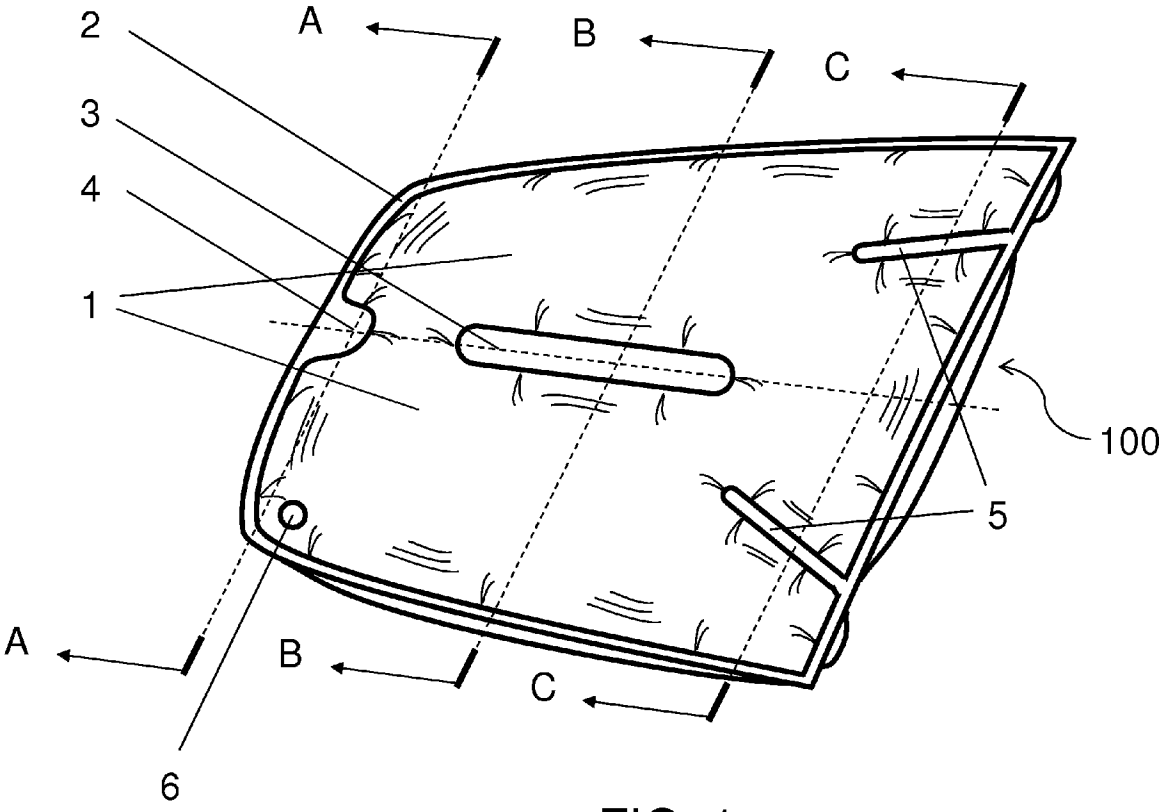
FIG. 1 is a perspective view of seat cushion in one embodiment of the current invention.

Turning now to FIG. 1, a perspective view of seat cushion in one embodiment of the current invention is shown. In this embodiment, a continuous air bladder 100 is in a semi-inflated state and defined by border 2, first weld area 4, second weld area 3, third weld areas 5, valve 6 and weight bearing areas 1. One of ordinary skill in the art would appreciate that embodiments of the present invention could include additional or fewer components than those identified in FIG. 1.

According to an embodiment of the present invention, the air bladder may be constructed from one or more air tight materials such as, but not limited to, polymer films or polymer coated or laminated fabrics. One of ordinary skill in the art would appreciate that there are numerous materials that could be used in construction of the air bladder, and embodiments of the present invention are contemplated for use with any appropriate material.

According to an embodiment of the present invention, the border 2 may be a continuous linear area welded between the upper and lower sides of air bladder 100 and configured to assure air tightness of the air bladder 100.

According to an embodiment of the present invention, the first weld area 4 is an area welded between upper and lower sides of the air bladder 100 and is configured to create a void of inflation at the rear portion of the air bladder 100. Said first weld area 4 concaves inward from a rear edge of the multifunctional posture seat and along a front-to-back middle axle of the multifunctional posture seat. The first weld area 4 corresponds with user's coccyx region. Void of inflation in this area helps relieve pressure in user's coccyx region, which is important to users with damaged or sensitive coccyx.

According to an embodiment of the present invention, the second weld area 3 is an area welded between upper and lower sides of the air bladder 100, running along the front-to-back middle axle of the multifunctional posture seat without touching a tip of the first area 4 and a front edge of the seat cushion. Said second area 3 corresponds with a user's perineum region, and is configured to create a void of air inflation in the middle of the air bladder 100. Void of inflation in this area helps relieve pressure in user's perineum region, which is important to prostate patients, hemorrhoid patients and mothers who recently gave birth. Said second weld area 3 does not touch a tip of the first area 4 is important for creating effective counterbalance against the backward rolling tendency of the pelvis, as the void of weld between first area 4 and second area 3 allows air bladder 100 to expand in this region. Sufficient expansion in this region is critical for creating effective counterbalance against the backward rolling tendency of the pelvis hence to help reduce slouching while sitting.

According to an embodiment of the present invention, the third weld areas 5 are a plurality of areas welded between upper and lower sides of air bladder 100 and are to create desired voids of inflation in the front portion of the air bladder 100. The third weld areas 5 correspond with a lower left thigh area and a lower right thigh area of the user. Void of inflation in these areas help improve pressure distribution underneath the user's thighs and help smooth out pressure transition from the parts of the thighs on the cushion and those off the cushion which is important to users with blood circulation issues in the legs. Said third weld areas run inwards from the front edge along two symmetrical lines without touching the rear edge of the multifunctional posture seat, wherein no part of the air chamber is excluded from a single air dissipation and flow channel allowing air to flow freely between the first area, the second area and the plurality of areas formed in the air chamber.

According to an embodiment of the present invention, one or more valves 6 are mounted on the air bladder 100 for inflation or deflation of the air bladder 100. While FIG. 1 shows only one valve 6, embodiments of the present invention may utilize any number of valves. Increasing the amount of air valves may allow for the ability to increase the rate at which inflation or deflation of the air bladder 100 occurs, or it may act as redundancy in the case one or more air valves clog or become inoperable.

According to an embodiment of the present invention, the valves 6 may allow for the multifunctional posture seat to be inflated and/or deflated in a variety of manners. In certain embodiments, the valve may allow for manual inflation/deflation by way of a manual pump, or simply by the user breathing into the valve until the desired inflation is achieved. In certain embodiments, deflation may be done by pinching or turning the valve.

In certain embodiments, the valves 6 may work in conjunction with one or more automated inflation/deflation means. For instance, the valves 6 may be attached to a powered pump programmed to inflate and deflate the air bladder 100 in certain patterns of amount, intervals, speed, or any combination thereof. One of ordinary skill in the art would appreciate that there are numerous pump patterns that could be utilized with embodiments of the present invention and embodiments of the present invention are contemplated for use with any patter for inflating or deflating the air bladder. In other embodiments, the multifunctional posture seat may have an integrated pump or other inflation/deflation system built-in. One of ordinary skill in the art would appreciate that there are numerous inflation/deflation means that could be utilized with embodiments of the present invention and embodiments of the present invention are contemplated for use with any appropriate inflation/deflation means. In certain embodiments, the multifunctional posture seat may be pre-inflated and formed without any valves.

According to an embodiment of the present invention, the weight bearing areas 1 correspond to the ischial tuberosities and the surrounding weight bearing contact areas of the body while sitting. The thickness of said weight bearing areas after inflation is limited by the various welded areas in surrounding region. Such limited thickness is critical to offering effective proprioceptive stimulation and support in a non-risky, comfortable and non-distractive manner to help reduce or prevent many health issues related to prolonged sitting.

According to an embodiment of the present invention, the welding and mounting associated with the seat can be accomplished with technologies such as, but not limited to, radio frequency welding or high frequency welding. One of ordinary skill in the art would appreciate that there are numerous types of welding and mounting means that could be utilized with embodiments of the present invention, and embodiments of the present invention are contemplated for use with any type of welding type or mounting means.

Figure 2:
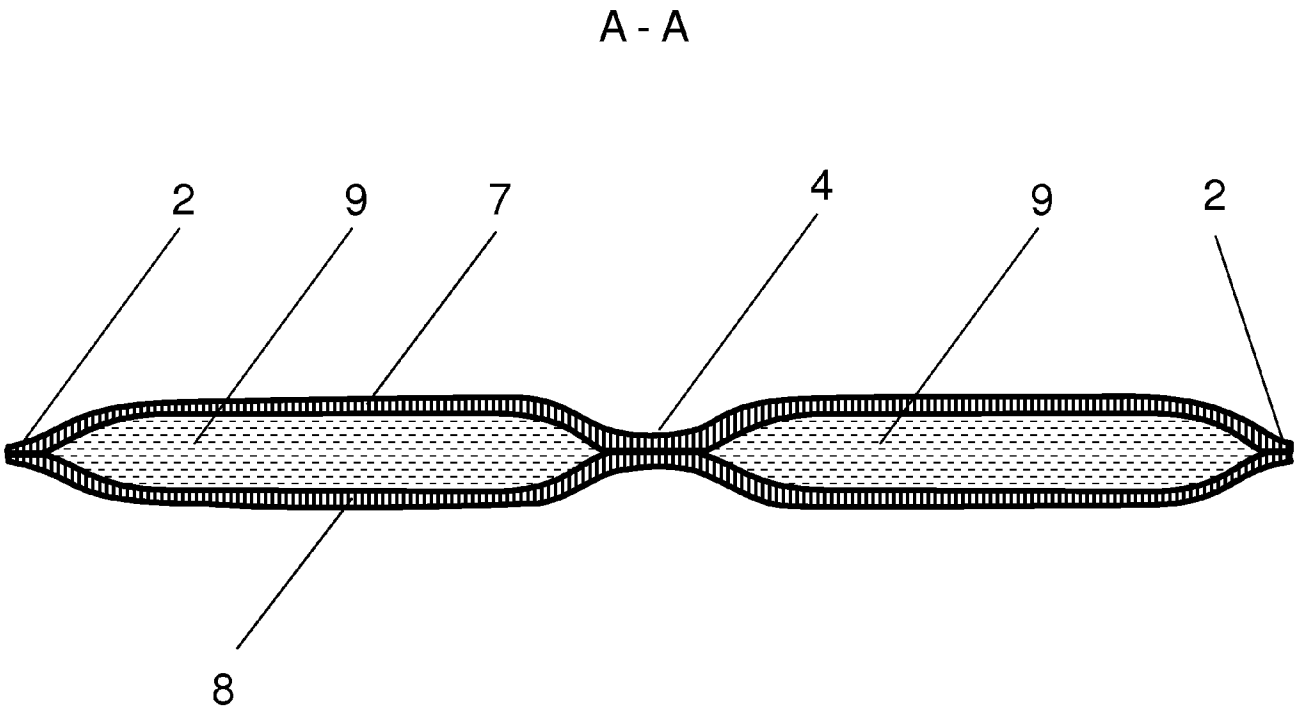
FIG. 2 is a cross section view of the cushion of FIG. 1.

Turning now to FIG. 2, a cross section (A-A) view of the seat cushion in one embodiment of the current invention, is shown. In this embodiment, an upper side 7 and a lower side 8 of the seat cushion are welded together via the border 2 and the second weld area 4. Void spaces 9 are spaces inside the air bladder due to inflation. Void spaces 9 are connected inside the air bladder.

Figure 3:
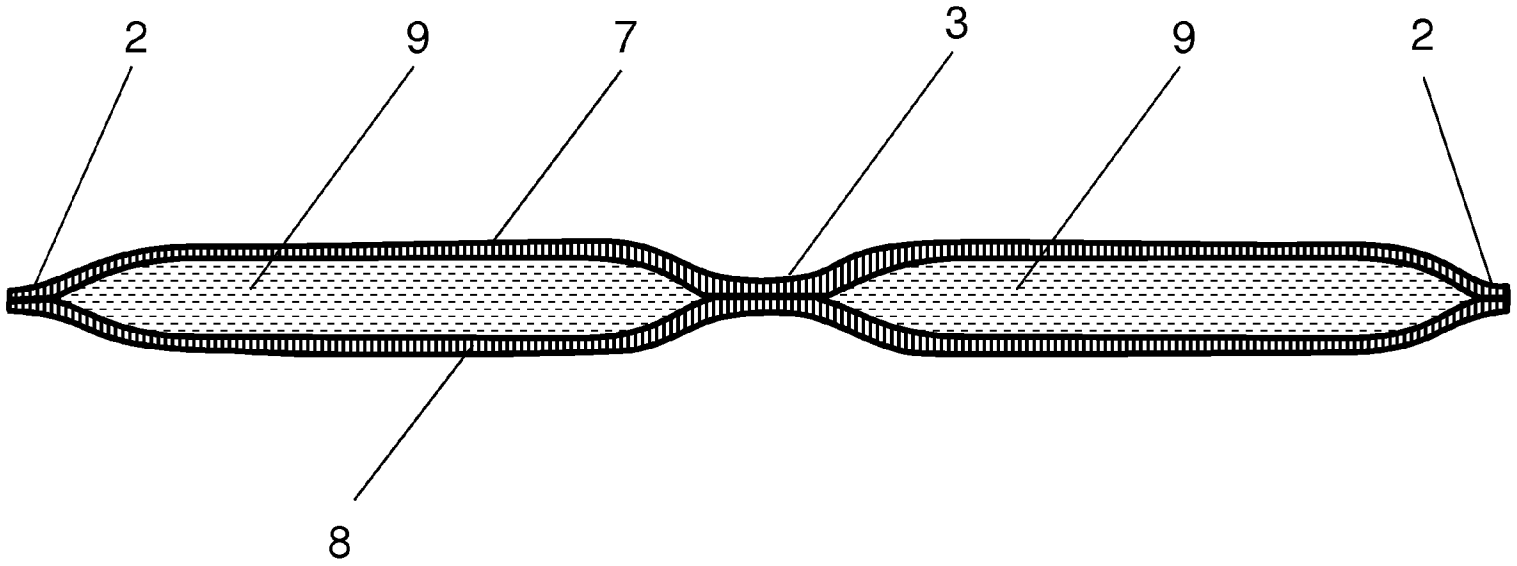
FIG. 3 is another cross section view of the cushion of FIG. 1.

Turning now to FIG. 3, a cross section (B-B) view of the seat cushion in one embodiment of the current invention is shown. An upper side 7 and a lower side 8 of the seat cushion are welded together via the border 2 and the first weld area 3. Void spaces 9 are spaces inside the air bladder due to inflation. Void spaces 9 are connected inside the air bladder.

Figure 4:
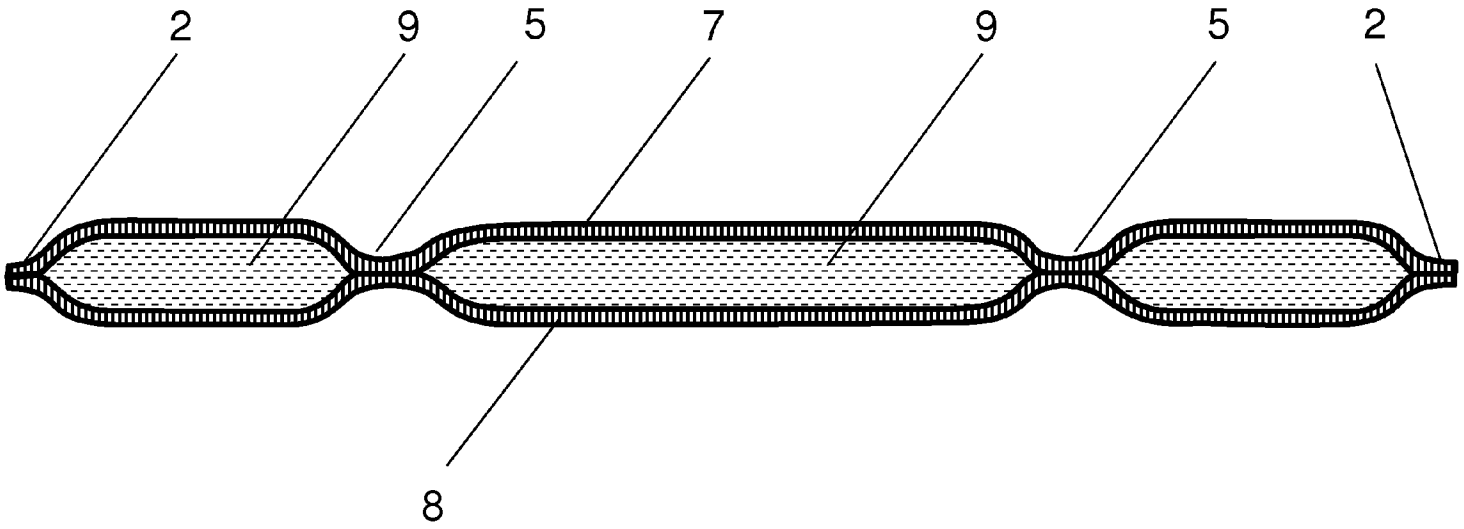
FIG. 4 is another cross section view of the cushion of FIG. 1.

Turning now to FIG. 4, a cross section (C-C) view of the seat cushion in one embodiment of the current invention is shown. An upper side 7 and a lower side 8 of the seat cushion are welded together via the border 2 and the third weld areas 5. Void spaces 9 are the spaces inside the air bladder due to inflation. Void spaces 9 are connected inside the air bladder 1.

According to an embodiment of the present invention, it is very simple to use embodiments of the multifunctional posture seat described herein. A user only needs to first customize the inflation of the seat via an inflation/deflation valve to a desirable level. Then the user only needs to lift her ischial tuberosities slightly off the seat pane of her chair. This is critical to provide gentle proprioceptive stimulation and support while offering sufficient stability to allow the user to concentrate on her tasks on hand safely and comfortably. Then place the multifunctional posture seat flat in a chair with a first weld area 4 towards the back of the chair, and the opposite side of multifunctional posture seat roughly aligned with the front edge of the chair.

In this position, the user can gently sit centered on the multifunctional posture seat, with her tail bone roughly aligned with the rear edge of the multifunctional posture seat. She can simply keep sitting like she would normally do. While sitting, the rear portion of the multifunctional posture seat will bulge up and create counter-balance against the backward rolling tendency of user's pelvis and hence helps reduce and prevent slouching. Embodiments of the multifunctional posture seat will also provide gentle and on-going stability stimulation and exercises for user's upper body to help improve sitting posture, reduce physical inactivity of sitting, reduce the risk of back pain, stiffness and fatigue.

According to an embodiment of the present invention, the various weld areas (e.g., 3, 4, 5) help reduce pressure on some of the sensitive parts of the body, to improve sitting comfort for users with sensitive coccyx, perineum region and circulation challenges in the thighs. Through constant conformation to user's body, weight bearing areas 1 improve pressure distribution underneath user's buttocks and thighs.

Embodiments of the multifunctional posture seat, as described herein, allow users to convert most chairs into a stability chair instantly. Embodiments also offer ultra-portability and customizability while allowing users to use the multifunctional posture seat anywhere they wish, even on board airplanes. Best of all it offers the combined benefits of a number of health products in one simple-to-use and ultra-portable and practical device.

Figure 5:
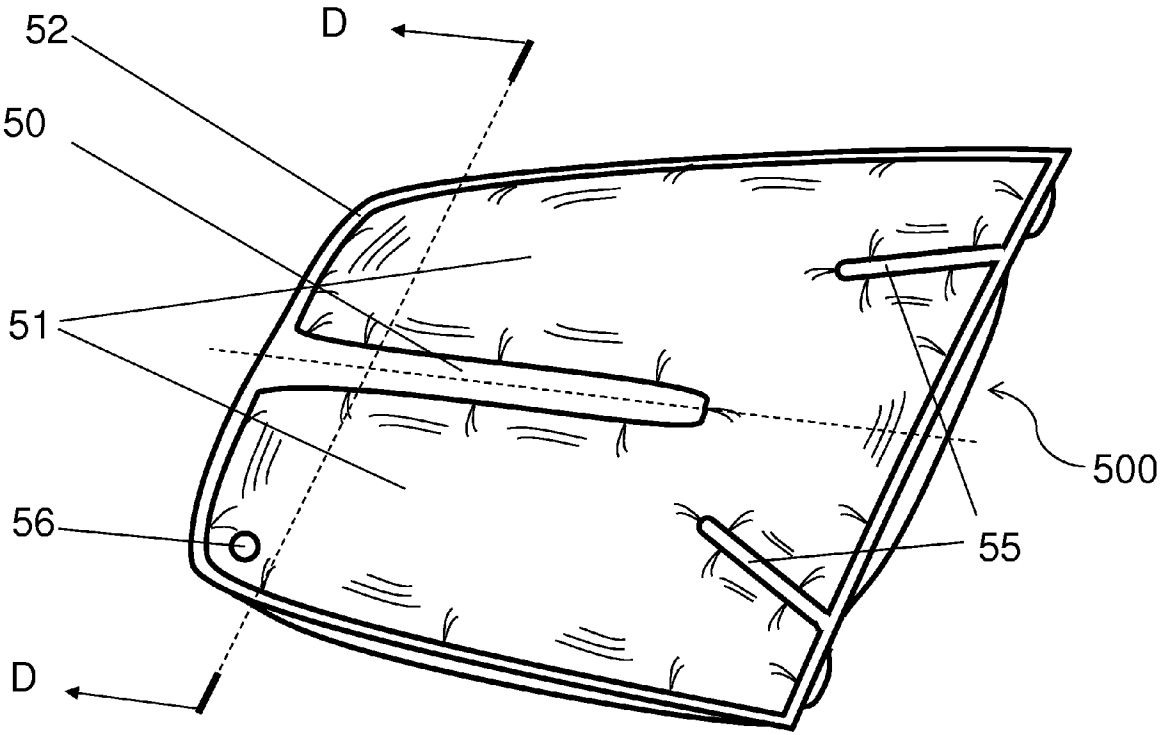
FIG. 5 is a perspective view of seat cushion in another embodiment of the current invention.

Turning now to FIG. 5, a perspective view of seat cushion in another embodiment of the current invention is shown. A continuous air bladder 500 is in a semi-inflated state and defined by a border 52, two weld areas 55, a first weld area 50, valve 56 and weight bearing areas 51.

According to an embodiment of the present invention, the border 52 is a continuous linear area welded between the upper and lower sides of the air bladder 500 and is to assure air tightness of the air bladder 500.

According to an embodiment of the present invention, the two weld areas 55 are areas welded between upper and lower sides of the air bladder 500 and are configured to create desired voids of inflation in the front portion of the air bladder 500.

According to an embodiment of the present invention, the two weld areas 55 correspond with user's thighs. Void of inflation in these areas help improve pressure distribution underneath user's thighs.

According to an embodiment of the present invention, the first weld area 50 is area welded between upper and lower sides of the air bladder 500 and is configured to create a void of air inflation in the middle and rare portions of the air bladder 500. The first weld area 50 corresponds with user's perineum and coccyx regions. Void of inflation in this area helps relieve pressure in user's perineum and coccyx region, which is important to prostate patients, hemorrhoid patients, mothers who recently gave birth and users with damaged or sensitive coccyx.

According to an embodiment of the present invention, valve 56 is mounted on the air bladder 500 for inflation or deflation of the air bladder 500. Weight bearing areas 51 is defined by above mentioned welded areas and correspond to user's ischial tuberosities and her surrounding weight bearing contact areas while sitting. The maximum inflated thickness of said weight bearing areas 51 is limited by said welded areas in surrounding region.

Figure 6:
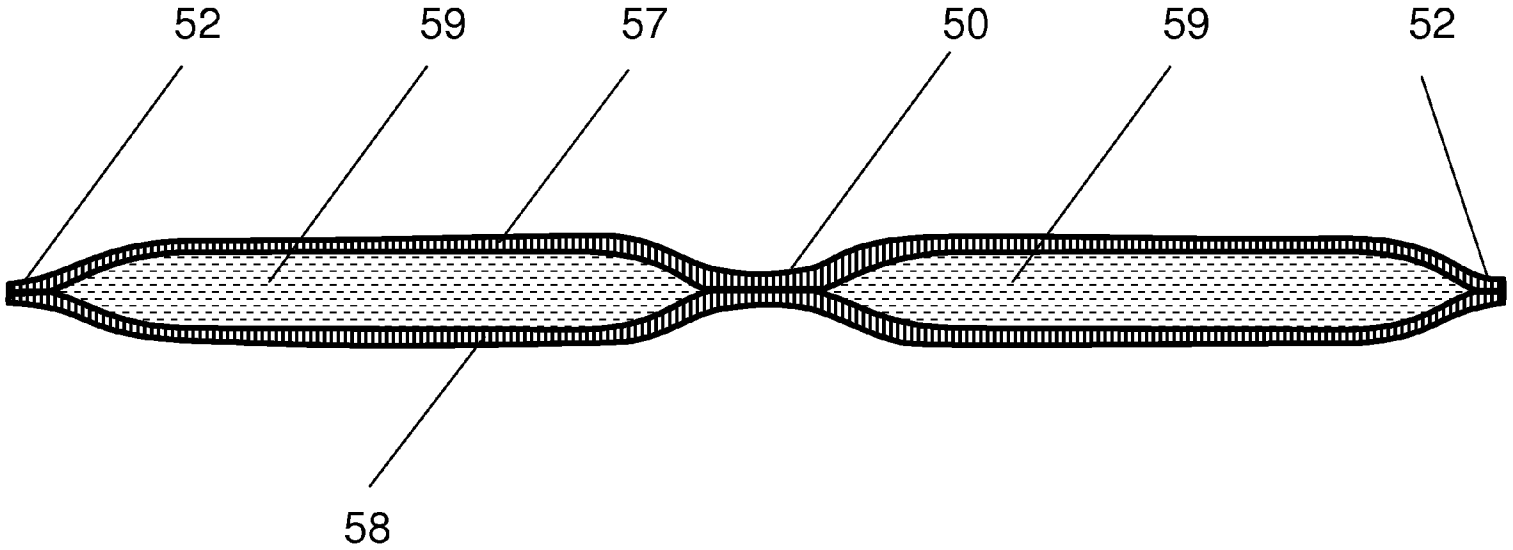
FIG. 6 is a cross section view of the cushion of FIG. 5.

Turning now to FIG. 6, a cross section (D-D) view of the seat cushion in accordance with an embodiment of the current invention, is shown. An upper side 57 and a lower side 58 of the seat cushion are welded together via the border 52 and first weld area 50. Void spaces 59 are the spaces inside the air bladder 500 due to inflation. Void spaces 59 are connected inside the air bladder 100.

Figure 7:
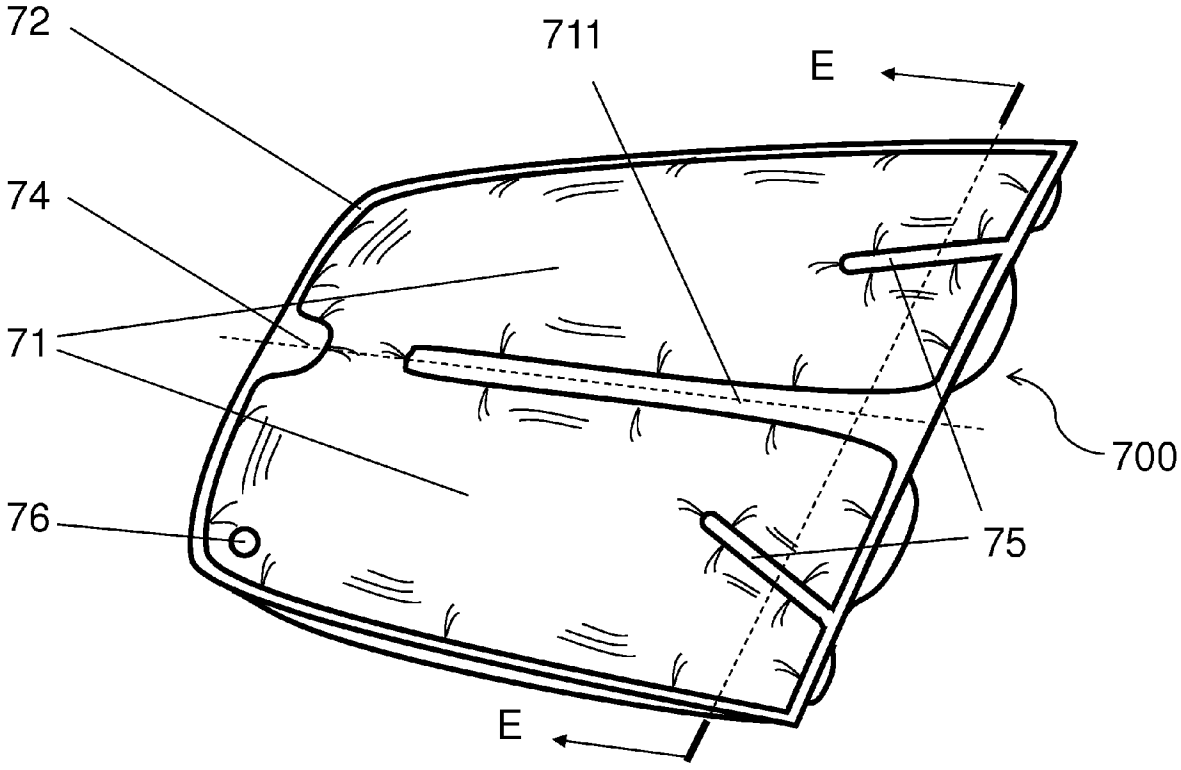
FIG. 7 is a perspective view of seat cushion in yet another embodiment of the current invention.

Turning now to FIG. 7, a perspective view of the seat cushion in yet another embodiment of the current invention is shown. A continuous air bladder 700 is in a semi-inflated state and defined by border 72, a first weld area 74, second weld areas 75, a third weld area 78, a valve 76 and weight bearing areas 71.

According to an embodiment of the present invention, the Border 72 is a continuous linear area welded between the upper and lower sides of the air bladder 700 and is to assure air tightness of the air bladder 700. The first weld area 74 is a welded between upper and lower sides of the air bladder 700 and is to create a void of inflation at the rare portion of air bladder 700. The second weld area 74 corresponds with user's coccyx region. Void of inflation in this area helps relieve pressure in user's coccyx region, which is important to users with damaged or sensitive coccyx.

According to an embodiment of the present invention, second Weld areas 75 are welds between upper and lower sides of the air bladder 700 and are configured to create desired voids of inflation in the front portion of the air bladder 700. Second weld areas 75 correspond with user's thighs. Void of inflation in these areas help improve pressure distribution underneath user's thighs.

According to an embodiment of the present invention, the third weld area 711 is welded between upper and lower sides of the air bladder 700 and is configured to create a void of air inflation in the middle and front portions of the air bladder 700. The third weld area 711 corresponds with a user's perineum region and region between the thighs. Void of inflation in this area helps relieve pressure in user's perineum region, which is important to prostate patients, hemorrhoid patients and mothers who recently gave birth.

According to an embodiment of the present invention, the valve 76 is mounted on the air bladder 700 for inflation or deflation of the air bladder 700. Weight bearing areas 71 is defined by above mentioned welded areas and correspond to user's ischial tuberosities and her surrounding weight bearing contact areas while sitting. The maximum inflated thickness of said weight bearing areas 51 is limited by said welded areas in surrounding region.

Figure 8:
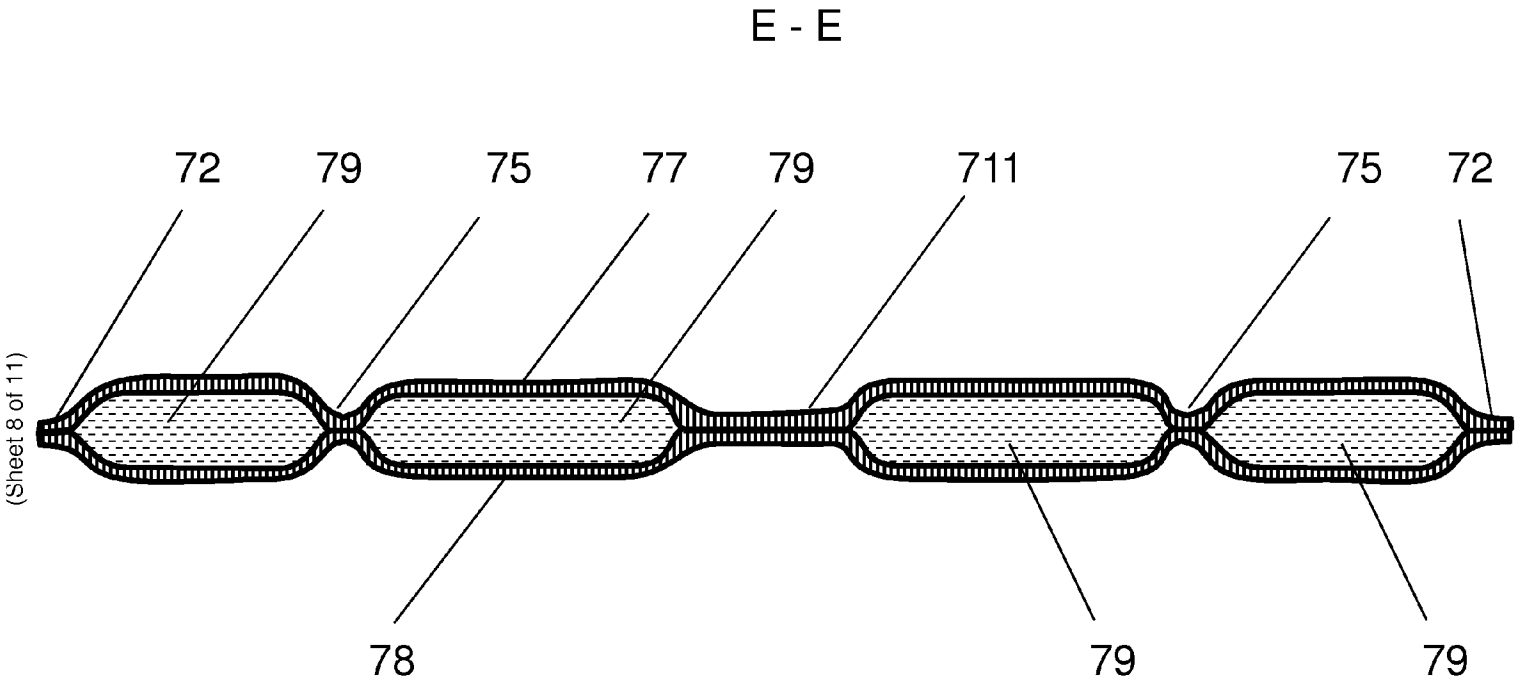
FIG. 8 is a cross section view of the cushion of FIG. 7.

Turning now to FIG. 8, a cross section (E-E) view of the seat cushion in yet another embodiment of the current invention is shown. An upper side 77 and a lower side 78 of the seat cushion are welded together via the border 72, two weld areas 75 and third weld area 711. Void spaces 79 are the spaces inside the air bladder 700 due to inflation. Void spaces 79 are connected inside the air bladder 700.

Figure 9:
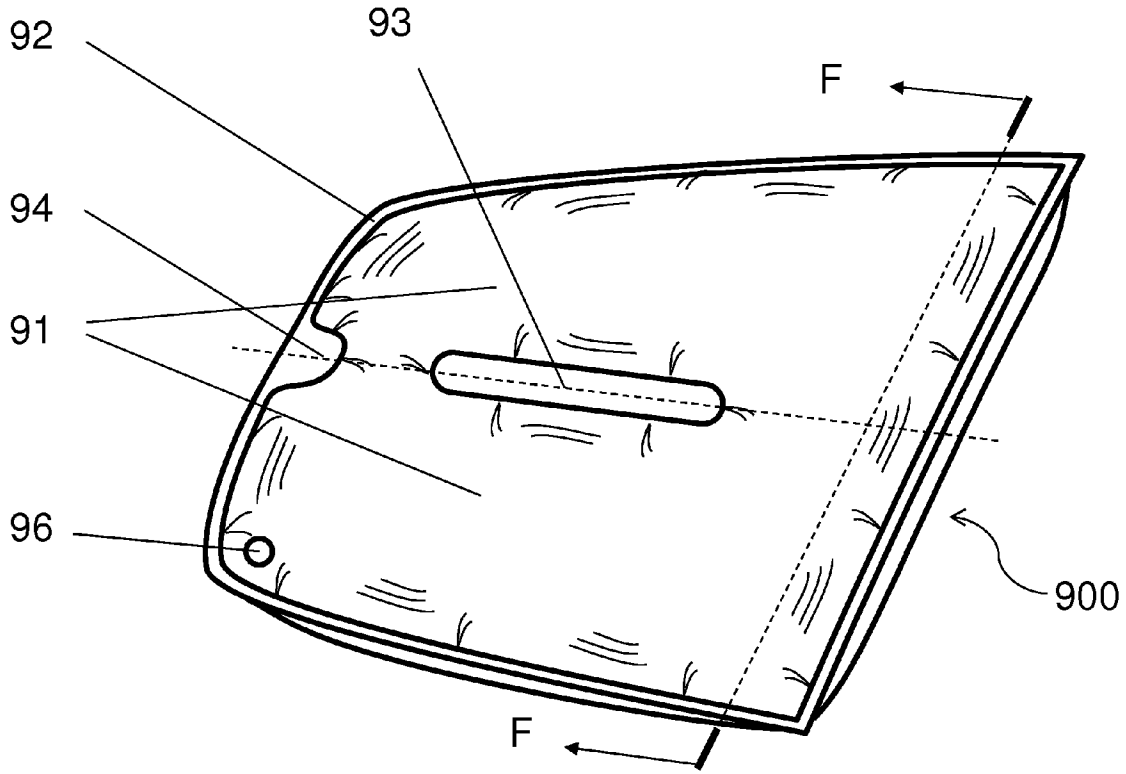
FIG. 9 is a perspective view of seat cushion in yet another embodiment of the current invention.

Turning now to FIG. 9, a perspective view of the seat cushion in yet another embodiment of the current invention is shown. A continuous air bladder 900 is in a semi-inflated state and defined by a border 92, a first weld area 93, a second weld area 94, a valve 96 and weight bearing areas 91.

According to an embodiment of the present invention, the Border 92 is a continuous linear area welded between the upper and lower sides of the air bladder 900 and is to assure air tightness of the air bladder 900.

According to an embodiment of the present invention, the first weld area 93 is a weld between upper and lower sides of air bladder 900 and is to create a void of inflation at the middle portion of air bladder 900. The first weld area 93 corresponds with user's perineum region. Void of inflation in this area helps relieve pressure in user's perineum region, which is important to prostate patients, hemorrhoid patients and mothers who recently gave birth.

According to an embodiment of the present invention, the second weld area 94 is a weld between upper and lower sides of air bladder 900 and is to create a void of inflation at the rare portion of air bladder 900. The second weld area 94 corresponds with user's coccyx region. Void of inflation in this area helps relieve pressure in user's coccyx region, which is important to user's with damaged or sensitive coccyx.

According to an embodiment of the present invention, the Valve 96 is mounted on the air bladder 900 for inflation or deflation of the air bladder 900. Weight bearing areas 91 is defined by above mentioned welded areas and correspond to user's ischial tuberosities and her surrounding weight bearing contact areas while sitting. The maximum inflated thickness of said weight bearing areas 91 is limited by said welded areas in surrounding region.

Figure 10:
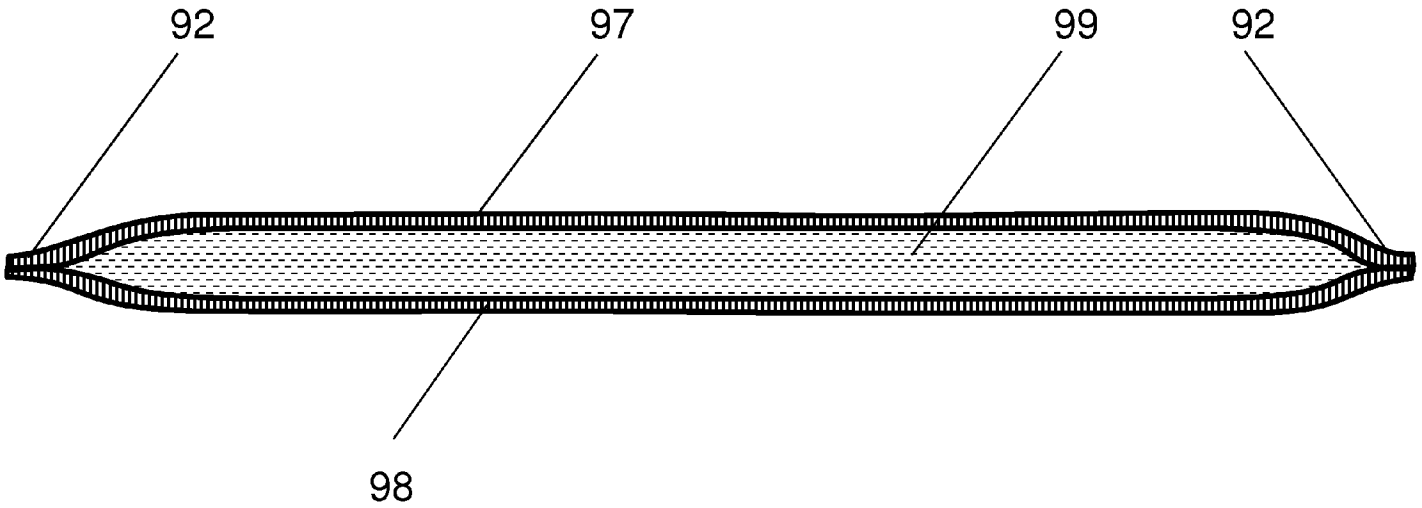
FIG. 10 is a cross section view of the cushion of FIG. 9.

Turning now to FIG. 10, a cross section (F-F) view of the seat cushion in yet another embodiment of the current invention is shown. An upper side 97 and a lower side 98 of the seat cushion are welded together via border 92. Void space 99 is the space inside the air bladder 900 due to inflation.

Figure 11:
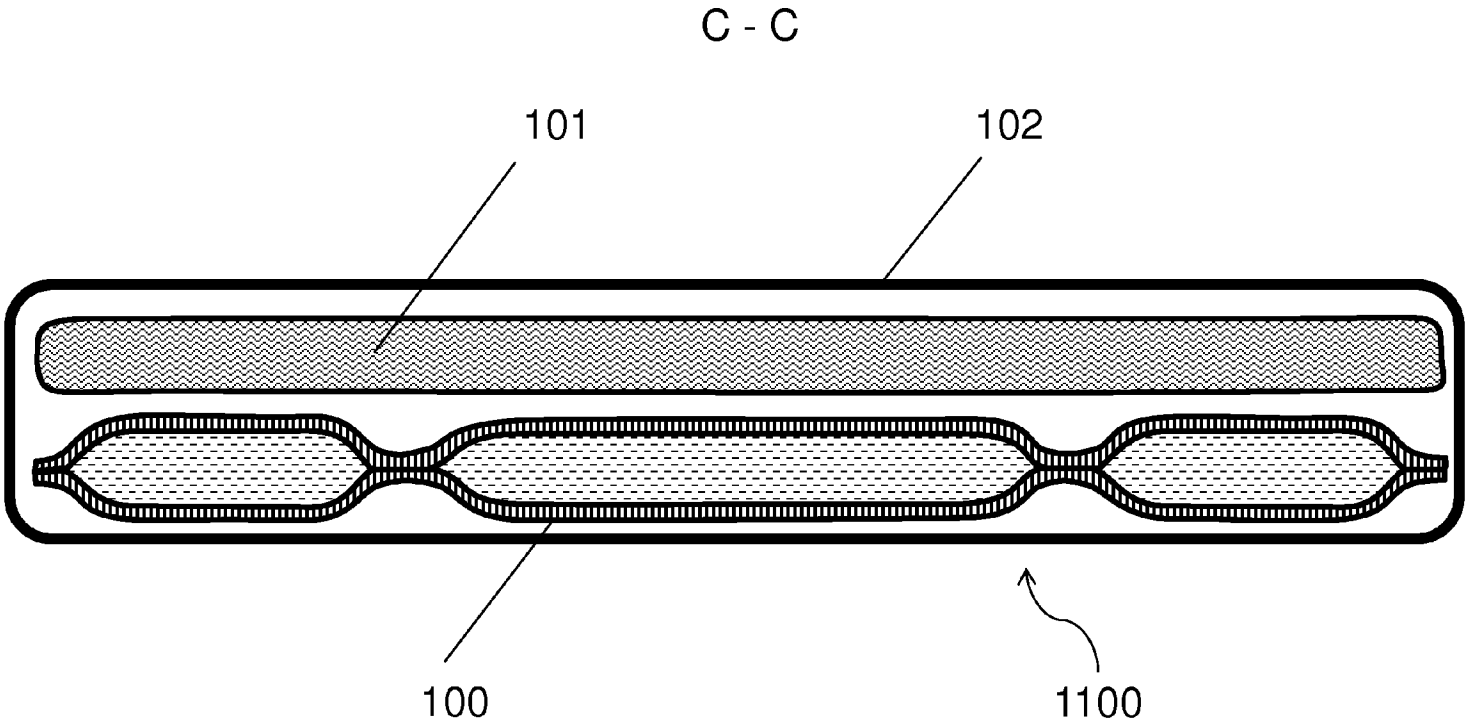
FIG. 11 is a cross section view of the cushion of FIG. 1 with an additional cushioning layer atop and a cover surrounding the assembly of said cushion and said additional cushioning layer.

Turning now to FIG. 11, a cross section (C-C) view of the seat cushion of FIG. 1 in yet another embodiment of the current invention is shown. A layer of cushioning material 101 is utilized on top of the air bladder 100. Said layer of cushioning material preferably spread out and cover the entire surface of said air bladder 100. The assembly of said air bladder 100 and said layer of cushioning material 101 is incased by an outer shell 102 to form cushion 1100. Said layer of cushioning material 101 helps further improve pressure distribution underneath buttocks. Said out shell 102 help further fine tune the sitting comfort to meeting user's individual preferences. The total cushion assembly 1100 provides superior therapeutic and orthotic performance and benefit to users. Further, in such an assembly, the air bladder 100 can be freely adjusted to suit user's needs. Air bladder 100 with various designs can be easily exchanged. Said cushioning layer can be made of, but not limited to, memory foam, gel, or structured EVA material. One of ordinary skill in the art would appreciate that there are numerous materials the cushioning could be made out of and embodiments of the present invention are contemplated for use with cushioning made from any appropriate materials.

In certain embodiments, the cushioning layer of various materials and physical characteristics such as thickness, hardness, density and structure can also be easily replaced to satisfy user's preferences and requirements. The closures on the cover provide additional options for accessing the cushion layer and air bladder 100. Special closures also allow for more fine control over the assembly's shape, tightness and conformability because they can be fastened and unfastened to achieve different tensions in the cover as it overlays the internal cushion elements of embodiments of the present invention. Such embodiment proves to be especially valuable and beneficial to wheelchair users.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A multifunctional posture seat comprising:

an inflatable air cushion;

a first semi-circular area formed in said air cushion that curves inward from a rear edge of said multifunctional posture seat and is disposed along an axis of symmetry of said multifunctional posture seat, said first area corresponds with a coccyx region of a user, wherein inflated areas on opposite sides of said first area define a depression that accommodates said coccyx region when a user is seated on said multifunctional posture seat thereby preventing compression of a coccyx of a user;

a second oval-shaped area formed in said air cushion centrally disposed along said axis of symmetry of said multifunctional posture seat, wherein said second area defines an island in said air cushion, wherein said second area corresponds to a perineum region of a user and is configured to reduce pressure on said perineum region; and two slanted rectangular areas formed in said air cushion that extend from a front edge of said multifunctional posture seat and converge towards each other, without touching each other, from opposite sides of said axis of symmetry, wherein said slanted areas correspond to lower left and lower right thigh areas of a user and are configured to improve pressure distribution on said lower left and lower right thigh areas, wherein air in said air cushion flows around said first, second, and slanted areas providing cushioned support for certain parts of the body of a user and pressure relief for other parts of the body of a user while contributing to good posture.

2. The multifunctional posture seat of claim 1, further comprising one or more valves integrally formed upon said air chamber.

3. The multifunctional posture seat of claim 2, wherein at least one of said valves allows for the inflation of said air chamber.

4. The multifunctional posture seat of claim 2, wherein said one or more valves are configured to allow for the manual inflation of said air chamber.

5. The multifunctional posture seat of claim 4, wherein said automated air pump is integrally formed in said multifunctional posture seat.

6. The multifunctional posture seat of claim 2, further comprising an automated air pump means configured to provide automatic inflation and deflation of said air chamber via said one or more valves.

7. The multifunctional posture seat of claim 2, further comprise a layer of cushioning material on top of said air chamber wherein said layer of cushioning material covers an entire top surface of said air chamber.

8. The multifunctional posture seat of claim 7, further comprising an outer shell encasing said air chamber and said layer of cushioning material.

9. The multifunctional posture seat of claim 1, wherein said air chamber is filled with air before said multifunction posture seat is used.

10. A multifunctional posture seat, comprising:

an inflatable air cushion bounded on an outside border formed by welding an upper side of said multifunctional posture seat to a lower side of said multifunctional posture seat;

a first rectangular weld area formed in said air cushion extending from a rear edge of said multifunctional posture seat along an axis of symmetry thereof, wherein said first weld area divides weight bearing areas on either side of said axis of symmetry, said weight bearing areas correspond to ischial tuberosities of a user seated on said multifunctional posture seat, wherein said first weld area corresponds to perineum and coccyx regions of a user, wherein said first weld area is configured to channel air around said first area in said air cushion thereby defining a first void area, said first void area constituting a void of air inflation in a middle and rear portion of the air cushion, wherein said first void area is configured to relieve pressure in perineum and coccyx regions of a user;

a second weld area comprising two slanted rectangular areas formed in said air cushion that extend from a front edge of said multifunctional posture seat and converge towards each other, without touching each other, from opposite sides of said axis of symmetry, wherein said slanted areas correspond to lower left and lower right thigh areas of a user, wherein said slanted areas are configured to channel are around said slanted areas in said air cushion thereby defining a second void area, said second void area constituting a void of air inflation in a front portion of the air cushion, wherein said second void area is configured to improve pressure distribution underneath the thighs of a user.

11. The multifunctional posture seat of claim 10, further comprising one or more valves integrally formed upon said air chamber.

12. The multifunctional posture seat of claim 11, wherein at least one of said valves allows for the inflation of said air chamber.

13. The multifunctional posture seat of claim 11, wherein said one or more valves are configured to allow for the manual inflation of said air chamber.

14. The multifunctional posture seat of claim 11, further comprising an automated air pump means configured to provide automatic inflation and deflation of said air chamber via said one or more valves.

15. The multifunctional posture seat of claim 14, wherein said automated air pump is integrally formed in said multifunctional posture seat.

16. The multifunctional posture seat of claim 10, wherein said air bladder is filled with air before said multifunction posture seat is used.

17. The multifunctional posture seat of claim 10, further comprise a layer of cushioning material on top of said air bladder wherein said layer of cushioning material covers an entire top surface of said air chamber.

18. The multifunctional posture seat of claim 17, further comprising an outer shell encasing said air bladder and said layer of cushioning material.

19. A multifunctional posture seat, comprising:

an inflatable air cushion bounded on an outside border formed by welding an upper side of said multifunctional posture seat to a lower side of said multifunctional posture seat;

a first semi-circular weld area formed in said air cushion that curves inward from a rear edge of said multifunctional posture seat and is disposed along an axis of symmetry thereof, said first weld area corresponds with a coccyx region of a user, wherein said first weld area is configured to channel air around said first area in said air cushion thereby defining a first void area, said first void area constituting a void of air inflation in a rear portion of the air cushion, wherein said first void area is configured to relieve pressure on said coccyx region;

a second weld area comprising two slanted rectangular areas formed in said air cushion that extend from a front edge of said multifunctional posture seat and converge towards each other, without touching each other, from opposite sides of said axis of symmetry, wherein said slanted areas correspond to lower left and lower right thigh areas of a user, wherein said slanted areas are configured to channel air around said slanted areas in said air cushion thereby defining a second void area, said second void area constituting a void of air inflation in a front portion of the air cushion, wherein said second void area is configured to improve pressure distribution underneath the thighs of a user;

a third rectangular weld area formed in said air cushion extending from a front edge of said multifunctional posture seat, between said slanted rectangular areas, along an axis of symmetry of said multifunctional posture seat, wherein said third weld area corresponds to a perineum region and region between the thighs of a user, wherein said third weld area is configured to channel air around said third area in said air cushion thereby defining a third void area, said third void area constituting a void of air inflation in a middle and front portion of the air cushion, wherein said third void area is configured to relieve pressure in a perineum region of a user.

* * * * *